US007395798B2

(12) United States Patent
Matsuda

(10) Patent No.: US 7,395,798 B2
(45) Date of Patent: Jul. 8, 2008

(54) ENGINE FOR LEISURE VEHICLE WITH LUBRICATING OIL PUMP AND ACTUATOR DRIVE OIL PUMP

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 27 days.

(21) Appl. No.: 11/336,645

(22) Filed: Jan. 20, 2006

(65) Prior Publication Data

US 2006/0174848 A1 Aug. 10, 2006

(30) Foreign Application Priority Data

Jan. 24, 2005 (JP) ..... 2005-015251

(51) Int. Cl.
*F01M 11/00* (2006.01)
*F01M 3/00* (2006.01)
*F01L 1/34* (2006.01)

(52) U.S. Cl. ..... 123/195 R; 123/90.15

(58) Field of Classification Search ..... 123/196 R, 123/90.15, 90.17, 196 CP, 198 C, 198 P, 123/195 A
See application file for complete search history.

(56) References Cited

U.S. PATENT DOCUMENTS 4,206,728 A * 6/1980 Trenne ..... 123/90.12
5,537,976 A * 7/1996 Hu ..... 123/322
5,680,841 A * 10/1997 Hu ..... 123/322
6,125,828 A * 10/2000 Hu ..... 123/568.14
6,129,060 A * 10/2000 Koda ..... 123/90.17
6,244,257 B1 * 6/2001 Hu ..... 123/568.14
6,516,686 B1 * 2/2003 Hori et al. ..... 74/730.1
6,736,091 B1 * 5/2004 Tibbles ..... 123/78 E
6,752,108 B2 * 6/2004 Katayama ..... 123/90.17
6,758,184 B1 * 7/2004 Lee et al. ..... 123/196 R
6,769,405 B2 * 8/2004 Leman et al. ..... 123/446
6,871,620 B2 * 3/2005 Aimone ..... 123/90.17
6,886,523 B2 * 5/2005 Steffes et al. ..... 123/196 R
6,923,091 B2 * 8/2005 Hori et al. ..... 74/606 R

FOREIGN PATENT DOCUMENTS

JP 60-155709 10/1985

OTHER PUBLICATIONS

"Recommended normal and minimum continuous duty oil pressure for Automic 4." Nov. 4, 2003. Moyer Marine Inc. Dec. 27, 2006. <http://web.archive.org/web/20031123111215/http://www.moyermarine.com/faq/3.7.html>.*

Jacobson, Harry. P.E. "Oil Pressure Specs." Feb. 14, 2005. About, Inc. Dec. 27, 2006. <http://experts.about.com/q/GM-GMC-781/Oil-Pressure-Specs.htm>.*

* cited by examiner

*Primary Examiner*—Noah P. Kamen
*Assistant Examiner*—Ka Chun Leung
(74) *Attorney, Agent, or Firm*—Alleman Hall McCoy Russell & Tuttle LLP

(57) ABSTRACT

An engine for a leisure vehicle including a lubricating oil pump configured to feed a lubricating oil to engine components, and an actuator drive oil pump that is provided separately from the lubricating oil pump and is configured to drive an actuator operating with an oil pressure. The actuator drive oil pump is configured to feed an oil with a discharge pressure higher than a discharge pressure of the lubricating oil pump.

7 Claims, 4 Drawing Sheets

ENGINE FOR LEISURE VEHICLE WITH LUBRICATING OIL PUMP AND ACTUATOR DRIVE OIL PUMP

TECHNICAL FIELD

The present invention relates to an engine for leisure vehicles such as motorcycles, all terrain vehicles (ATVs), utility vehicles, or personal watercraft (PWC).

BACKGROUND ART

In some leisure vehicles, for example, motorcycles, a lubricating oil pump is typically built into a four-cycle engine to feed a lubricating oil to engine components such as journal members or slidable members (see Japanese Utility Model Application Publication No. Sho. 60-155709).

In order to clean exhaust gases emitted from engines or to gain a high engine power, some engines are equipped with a variable valve system in which a lift amount of intake and exhaust valves and a valve timing are variable according to, for example, an engine speed. An actuator for driving the variable valve system is typically driven by an oil pressure of the lubricating oil of the engine which is fed from the lubricating oil pump.

However, the lubricating oil used to drive the actuator for driving the variable valve system may be degraded or may be diluted by a fuel (gasoline) flowing into an interior of a crankcase through a gap between a piston and a cylinder.

Conventionally, an electric motor is sometimes used to operate a throttle valve, a clutch, etc., by a "fly by wire" system. In this case, in order to operate the throttle valve, etc., quickly, the electric motor is required to generate a high output power. While the electric motor consumes a relatively high amount of electric power, a leisure vehicle such as a motorcycle has a limited electric capacity, in contrast to automobiles or trucks in general. If a large battery and a corresponding generator are equipped in a leisure vehicle, then the weight of the leisure vehicle increases. This is problematic, because light handling is desired during travel of the leisure vehicle.

SUMMARY OF THE INVENTION

The present invention addresses the above described problems, and an object of the present invention is to provide an engine suitable for a leisure vehicle that has a compact and efficient system for driving a hydraulically-powered actuator of the vehicle.

According to the present invention, there is provided an engine for a leisure vehicle comprising a lubricating oil pump configured to feed a lubricating oil to engine components; and an actuator drive oil pump that is provided separately from the lubricating oil pump and is configured to drive an actuator operating with an oil pressure, the actuator drive oil pump being configured to feed an oil with a discharge pressure higher than a discharge pressure of the lubricating oil pump.

In accordance with the engine for the leisure vehicle constructed above, the pressurized oil with an oil pressure that is higher than that of the lubricating oil fed by the lubricating oil pump is fed from the actuator drive oil pump to the actuator, such as a drive actuator of a variable valve system for intake and exhaust valves of the engine, a throttle valve drive actuator configured to operate a throttle valve, a clutch drive actuator configured to operate a clutch, or a suspension adjusting actuator configured to adjust stiffness (length) of a suspension. This makes it possible to drive these actuators quickly and efficiently. Further, the actuator can be made compact and a diameter of pipes coupling the actuator drive oil pump to the actuator can be reduced. Furthermore, it is not necessary to equip, in or with the engine, a heavy power-driven motor, a battery and a generator which are voluminous. As a result, weight of the vehicle body does not increase.

The actuator drive oil pump and the actuator may form an oil system independent of a lubricating oil system including the lubricating oil pump, and the oil system may further include an oil tank that reserves the oil fed to the actuator. Since the oil fed from the actuator drive oil pump to the actuator is separate from the lubricating oil for lubricating the engine components such as the journal members or the slidable members, it is not substantially degraded by lubrication and diluted by gasoline. Further, oil suitable for the actuator may be used as the oil fed from the actuator drive oil pump.

The discharge pressure of the actuator drive oil pump typically is not less than 8 $kgf/cm^2$ and not more than 150 $kgf/cm^2$ in order to operate the actuator quickly.

The actuator drive oil pump may be located adjacent a transmission provided in or on a rear region of the engine. Thereby, the actuator drive oil pump can be compactly disposed in the engine.

The actuator drive oil pump may be disposed at or in the vicinity of a center of gravity of the engine. Since the actuator drive oil pump with a relatively large weight is located at or in the vicinity of the center of gravity of the engine, the center of gravity of the engine and its peripheral devices is not substantially changed with the actuator drive oil pump mounted in or on the engine unit.

The actuator drive oil pump may be disposed in the vicinity of a rear face of a cylinder extending vertically upward from a crankcase of the engine and above the transmission. With this construction, since the actuator drive oil pump is protected by the cylinder and the casing of the transmission, and is located near a drive source, i.e., a crankshaft of the engine, a drive force can be efficiently transmitted from the crankshaft to the actuator drive oil pump. In addition, the actuator may be located in the vicinity of the center of gravity of the engine.

The actuator drive oil pump may be configured to be driven by a drive force transmitted from a crankshaft of the engine to the actuator drive oil pump through an output gear mounted on the crankshaft, a primary gear that is mounted on an input shaft of the transmission and is configured to mesh with the output gear of the crankshaft, a drive gear that is mounted on the input shaft of the transmission and is configured to rotate integrally with the primary gear, and a driven gear mounted on a rotational shaft of the actuator drive oil pump. With this construction, the actuator drive oil pump can be driven by the drive force with the number of rotations reduced to be adapted to the actuator drive oil pump. Furthermore, a system for driving the actuator drive oil pump may be disposed compactly in a transmission case of the engine.

An idle gear may be provided between the drive gear and the driven gear.

The actuator drive oil pump may be configured to be driven by the drive force transmitted from the crankshaft in such a manner that the number of rotations of the rotational shaft of the actuator drive oil pump is less than the number of rotations of the crankshaft.

The actuator may be configured to drive a variable valve system of the engine. Thereby, a variable valve is able to be driven quickly and efficiently.

The actuator drive oil pump may be disposed in the vicinity of a rear face of a cylinder extending vertically upward from a crankcase of the engine and above and adjacent to a transmission provided in a rear region of the engine. In this construction, a system for driving the variable valve system can be made compact.

The above and further objects and features of the invention will more fully be apparent from the following detailed description with accompanying drawings.

BRIEF DESCRIPTION OF THE DRAWINGS

FIG. 4 is a diagram schematically showing an oil flow circuit including the actuator drive oil pump of FIGS. 1 and 2, and an actuator or the like.

DETAILED DESCRIPTION OF THE PREFERRED EMBODIMENTS

Hereinafter, an engine for a leisure vehicle of the present invention will be described with reference to the drawings. Herein, an engine for motorcycles will be described with reference to the drawings.

Figure 1:
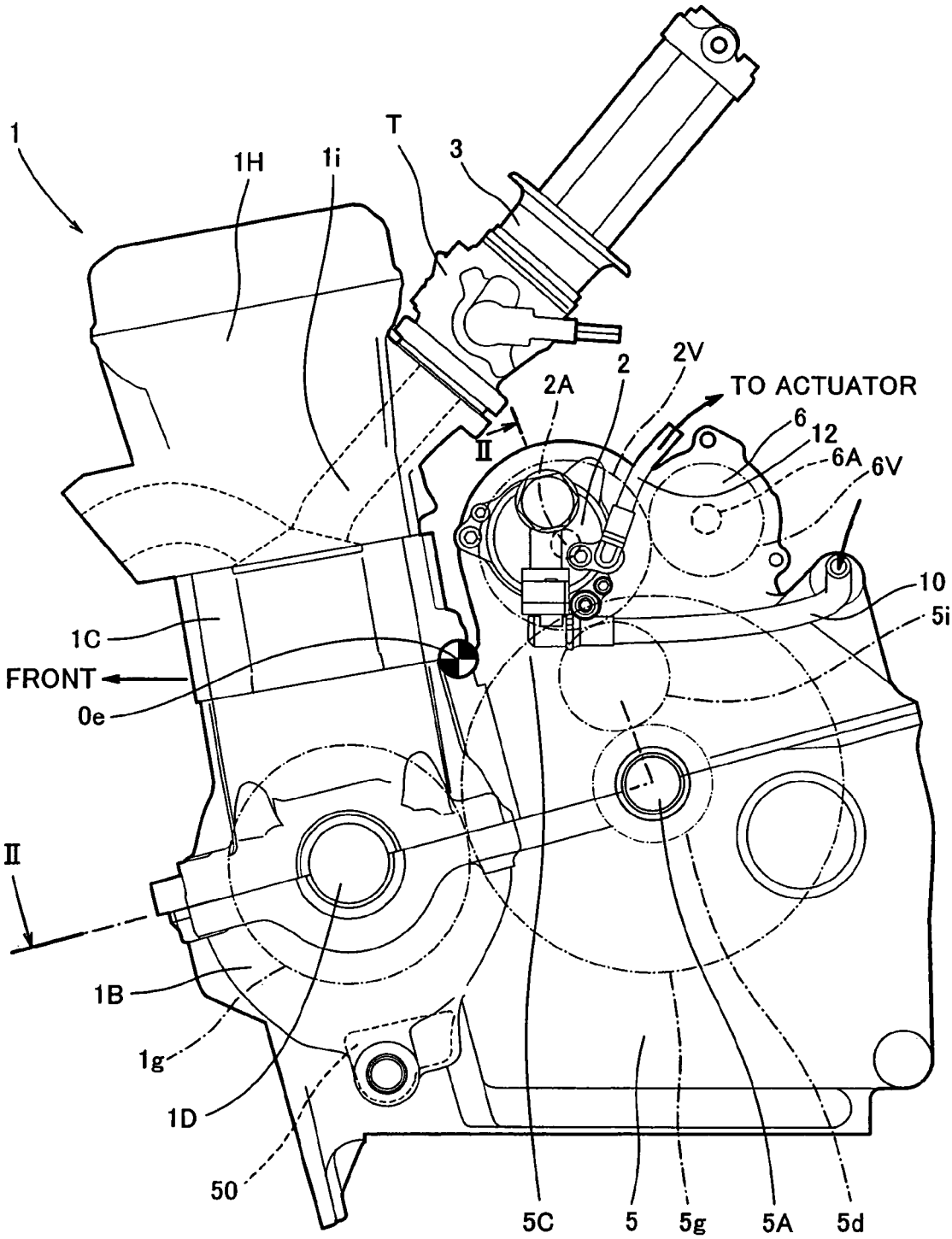
FIG. 1 is a side view showing a construction of an engine for a motorcycle according to an embodiment of the present invention.
Figure 3:
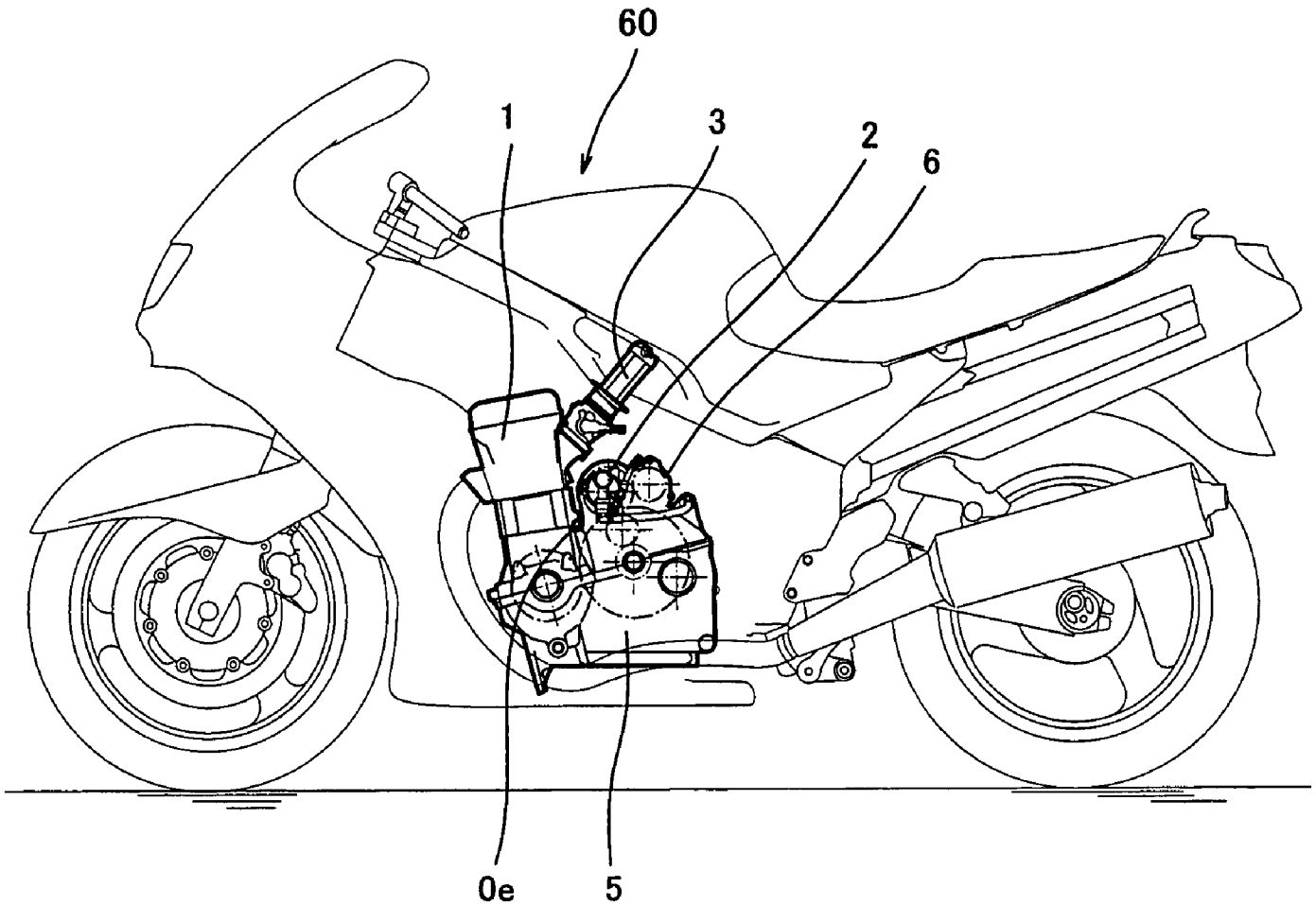
FIG. 3 is a side view of the motorcycle in which the engine of FIGS. 1 and 2 is mounted.

Turning now to FIG. 1, a four-cycle engine 1 is shown. The engine 1 is mounted in a motorcycle 60 (see FIG. 3) and is an inline multi-cylinder (e.g., four-cylinder) engine in which a plurality of cylinders 1C are aligned in a lateral (width) direction of the motorcycle 1 and are configured to extend substantially vertically. A cylinder head 1H is provided above each cylinder 1C. A crankcase 1B is disposed under the cylinder 1C to accommodate and support a crankshaft 1D. A transmission 5 of the engine 1 is mounted within a transmission casing 5C behind the crankcase 1B, i.e., rearward (rightward in FIG. 1) relative to the crankcase 1B in the direction in which the motorcycle 60 travels. The transmission casing 5C is integral with the crankcase 1B in this embodiment, but they may alternatively be separate from each other. In FIG. 1, an arrow F indicates "forward" in the direction in which the motorcycle 60 travels. The present invention is applicable to a single-cylinder engine or a V-type engine as well as to the inline multi-cylinder engine.

An air-intake device (throttle body including a fuel injector) 3 is disposed behind the cylinder head 1H and is configured to supply an air-fuel mixture (fresh air containing fuel) to an air-intake port 1*i* of the engine 1. An actuator drive oil pump 2 is mounted on an upper portion of the transmission casing 5C at a location under the air-intake device 3 and immediately behind the cylinder 1C.

Figure 2:
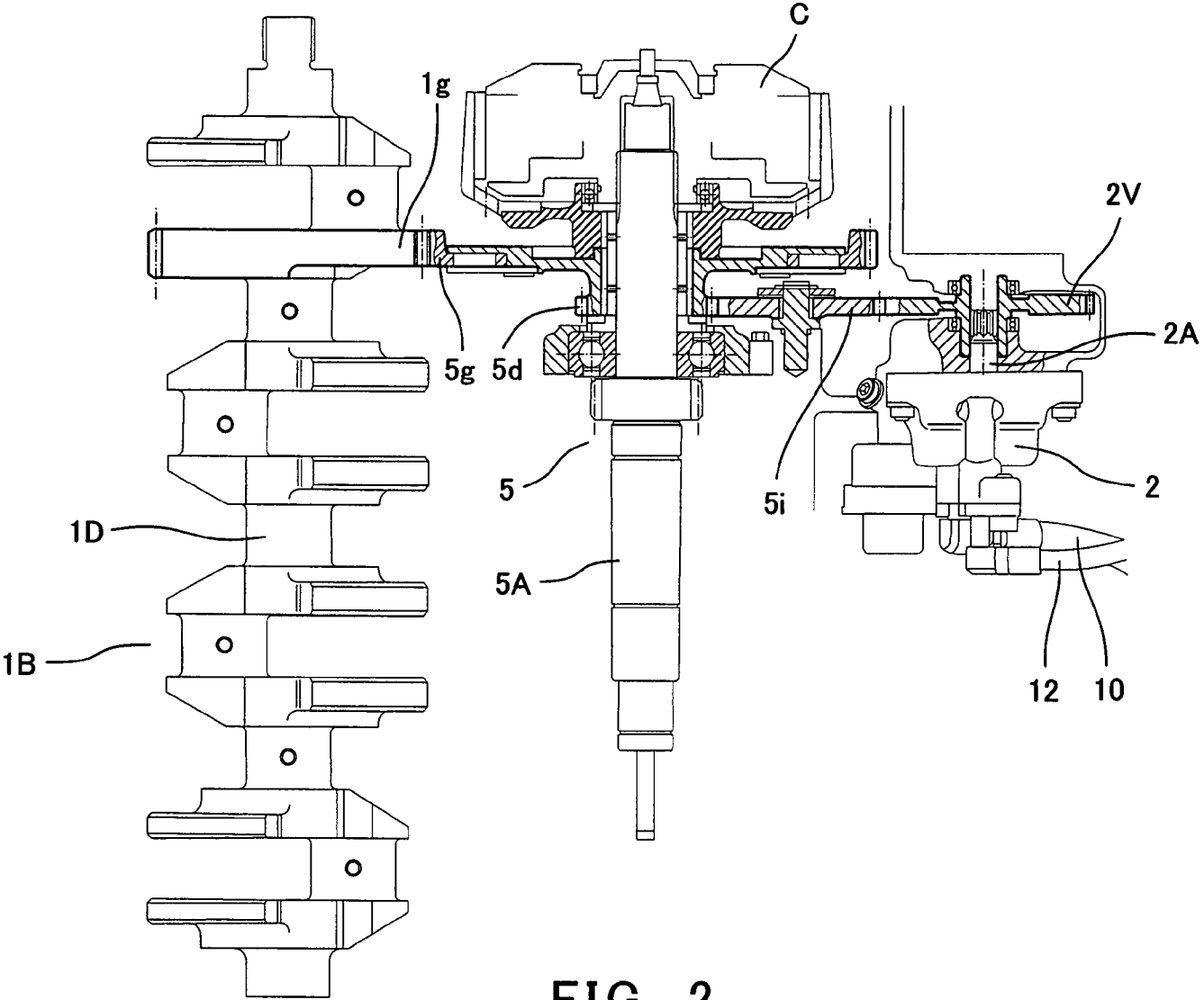
FIG. 2 is a view taken in the direction of arrows substantially along line II-II of the engine of FIG. 1, showing a drive system configured to drive an actuator drive oil pump.

As shown in FIG. 1 or 2, the actuator drive oil pump 2 is driven by a drive force transmitted from the crankshaft 1D disposed in the interior of the crankcase 1B to the actuator drive oil pump 2 through an output gear 1*g* mounted on the crankshaft 1D and plural gear trains for reducing the number of rotations of the crankshaft 1D. To be specific, the output gear 1*g* mounted on the crankshaft 1D is in mesh with a primary gear 5*g* mounted on an input shaft 5A rotatably supported by the transmission casing 5C. The input shaft 5A is provided with a clutch C which is connected to the primary gear 5*g*. A drive gear 5*d* is mounted on the input shaft 5A of the transmission 5 and is configured to rotate integrally with the primary gear 5*g*. The drive gear 5*d* is in mesh with an idle gear 5*i* rotatably mounted on the transmission casing 5C. The idle gear 5*i* is in mesh with a driven gear 2*v* mounted on a rotational shaft 2A of the actuator drive oil pump 2. As a result, the drive force is transmitted from the crankshaft 1D to the rotational shaft 2A of the actuator drive oil pump 2 such that the number of rotations of the rotational shaft 2A of the actuator drive oil pump 2 is less than the number of rotations of the crankshaft 1D, for example, about one third. This illustrated reduction ratio is merely exemplary and may be varied depending on the number of rotations of the crankshaft 1D of the engine 1 or depending on a characteristic of the actuator drive oil pump 2.

In the above configuration, the actuator drive oil pump 2 is driven by the crankshaft 1D to pump the oil so that the oil with an increased pressure is discharged from a discharge port 2*o* (see FIG. 4) of the oil pump 2. In order to efficiently drive the actuator 20, a discharge pressure of the actuator drive oil pump 2 is set higher than an oil pressure of lubricating oil discharged from an outlet port of a lubricating oil pump of the engine 1, for example, not less than 8 kgf/cm$^2$ and not more than 150 kgf/cm$^2$, more preferably not less than 10 kgf/cm$^2$ and not more than 50 kgf/cm$^2$. In the depicted embodiment, a gear oil pump with a discharge pressure of not less than 10 kgf/cm$^2$ and not more than 20 kgf/cm$^2$ is used as the actuator drive oil pump 2. The illustrated gear pump type oil pump is merely exemplary and other suitable oil pumps may be used.

Figure 4:
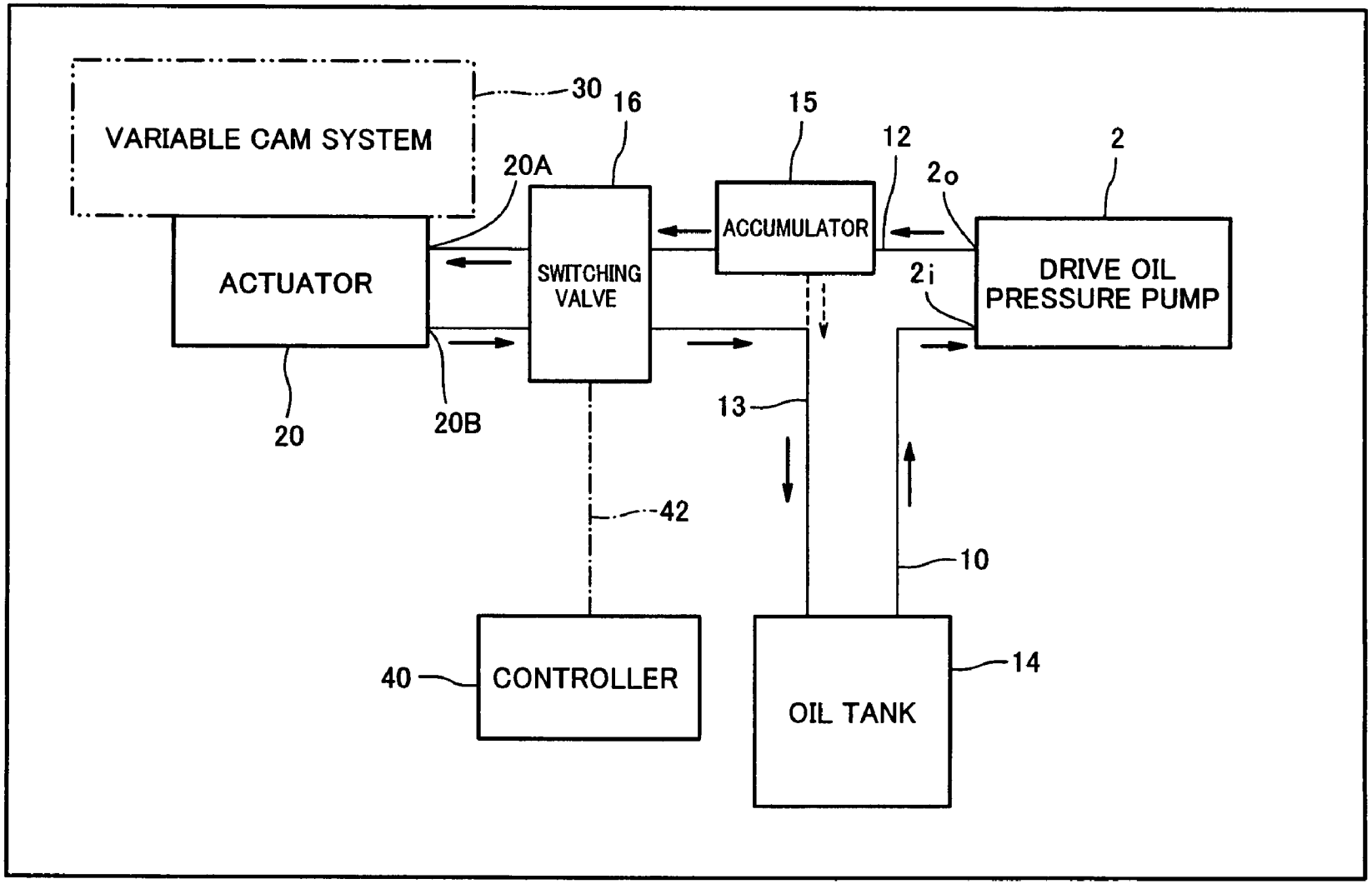

As shown in FIG. 4, the actuator drive oil pump 2 is further provided with a suction port 2*i*. A suction pipe 10 is coupled to an oil tank 14 that reserves oil for driving the actuator 20. An upstream end of the suction port 2*i* is coupled to a downstream end of the suction pipe 10. The suction port 2*i* is configured to suction the oil from the interior of the oil tank 14. As used herein, the terms "upstream" and "downstream" are directions in an oil flow of an oil circuit of the oil used to drive the actuator 20. The oil tank 14 is provided exclusively for an oil system configured to drive the actuator 20, separately from an oil pan or an oil tank that reserves the lubricating oil of the engine 1. The discharge port 2*o* is coupled to an upstream end of a feed pipe 12. A downstream end of the feed pipe 12 is coupled to a pressured oil feed port 20A of the actuator 20 (e.g., actuator of a variable valve system 30) through an accumulator 15 and a switching valve 16.

A downstream end of a return pipe 13 is coupled to the oil tank 14. A pressured oil discharge port 20B of the actuator 20 is coupled to an upstream end of the return pipe 13 through the switching valve 16. The switching valve 16 is communicatively coupled to a controller 40, for example, an engine control unit (ECU) through a control line 42. The switching valve 16 is opened and closed under the control of the controller 40 so that the pressurized oil is or is not fed from the actuator drive oil pump 2 to the actuator 20.

As shown in FIG. 1, a generator 6 is mounted on the transmission 5 and is located behind the actuator drive oil pump 2. A driven gear 6*v* is mounted on a rotational shaft 6A of the generator 6. The driven gear 6*v* is configured to mesh with the driven gear 2*v* mounted on the rotational shaft 2A of the actuator drive oil pump 2 and to be thereby driven.

A cam system (not shown in FIG. 1) is mounted in the interior of the cylinder head 1H of the engine 1 and is configured to open and close a valve of the engine 1. The cam system is the variable valve system 30 shown in FIG. 4. The variable valve system 30 is capable of varying an eccentric amount of the cam by turning on and off the actuator 20 (see FIG. 4), by stepwisely changing an operating portion of the actuator 20, or by non-stepwisely changing the operation of the actuator 20.

The actuator 20 is not limited to the actuator of the variable valve system 30, but may be other suitable actuators such as a throttle valve drive actuator configured to operate a throttle valve, a clutch drive actuator configured to operate a clutch, or a suspension adjusting actuator configured to adjust stiffness (length) of a suspension. The pressurized oil with an increased pressure may be fed from the actuator drive oil pump 2 to these actuators.

The engine 1 employs a wet sump lubricating system. The lubricating oil of the engine 1 is reserved in a bottom portion (oil pan) of the crankcase 1B. A lubricating oil pump 50 is mounted in the bottom portion of the crankcase 1B. The lubricating oil pump 50 pumps the lubricating oil to the journal members or the slidable members of the engine 1. In the depicted embodiment, the discharge pressure of the lubricating oil pump 50 is 4 kgf/cm$^2$ to 5 kgf/cm$^2$, which is a typical discharge pressure of the motorcycle 60.

During running of the engine 1 of the motorcycle 60 (see FIG. 3), the rotational shaft 2A of the actuator drive oil pump 2 is caused to rotate with the number of rotations that is less than the number of the rotations of the crankshaft 1D. The pressurized oil with an increased pressure is fed from the discharge outlet 2*o* of the actuator drive oil pump 2 to the accumulator 15. When the pressure of the accumulator 15 becomes a predetermined pressure or more, a relief valve of the accumulator 15 (not shown) opens, so that the pressurized oil from the actuator drive oil pump 2 is returned from the accumulator 15 to the oil tank 14. As a result, the pressurized oil maintained at a predetermined pressure is always accumulated in the accumulator 15.

Under this condition, in order to operate the actuator 20 of the variable valve system 30, the controller 40 causes the switching valve 16 to open. Thereby, the actuator 20 is connected to the accumulator 15. Under this condition, the pressurized oil with the predetermined pressure is fed from the accumulator 15 to the actuator 20, which thereby operates. As a result, a variable element of the variable valve system 30 operates, causing the cam of the variable valve system 30 to be eccentrically displaced to a condition suitable for the condition of the engine 1. The operation of the variable valve system 30 is carried out quickly and surely with a pressure that is twice to five times higher than a pressure of the conventional lubricating oil pump. In addition, the actuator 20 can be small-sized and passages coupling the actuator drive oil pump 2 to the actuator 20 can have a smaller diameter.

The clutch drive actuator may be configured to operate the clutch (not shown) or the throttle valve drive actuator (not shown) may be configured to operate (open and close) the throttle valve (not shown) of the intake device 3 in the same manner that the actuator 20 drives the variable valve system 30. In that case, the clutch or the throttle valve is able to be operated quickly with a small force by "fly by wire."

In addition, the suspension adjusting actuator (not shown) may be configured to act on the variable suspension (not shown) in the same manner that the actuator drive oil pump 20 drives the variable valve system 30. During travel of the motorcycle, the stiffness (length) of the suspension can be adjusted. As a result, an optimal cornering characteristic or an optimal braking characteristic can be achieved.

Since in this embodiment the actuator drive oil pump 2 with a relatively large weight (approximately 4 to 6 kg) is mounted on an upper portion of the transmission casing 5C at a location immediately behind the cylinder 1C, i.e., in the vicinity of a center of gravity Oe of the engine E, the center of gravity Oe of the engine E is not substantially changed with the actuator drive oil pump 2 mounted in or on the engine unit.

The present invention is applicable to other leisure vehicles such as ATVs, utility vehicles, and PWCs, as well as to motorcycles.

The present invention is applicable to two-cycle engines where the actuator is a throttle valve drive actuator configured to operate the throttle valve, a clutch drive actuator configured to operate the clutch, or a suspension adjusting actuator configured to adjust the stiffness (length) of the suspension.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. An engine for a leisure vehicle comprising:

a lubricating oil pump configured to feed a lubricating oil to engine components; and an actuator drive oil pump that is provided separately from the lubricating oil pump and is configured to drive an actuator operating with an oil pressure, the actuator drive oil pump being configured to feed an oil with a discharge pressure higher than a discharge pressure of the lubricating oil pump;

wherein the discharge pressure of the actuator drive oil pump is not less than 8 kgf/cm$^2$ and not more than 150 kgf/cm$^2$; and wherein the actuator drive oil pump is located adjacent a transmission provided in a rear region of the engine.

2. The engine for a leisure vehicle according to claim 1, wherein the actuator drive oil pump is disposed at or in the vicinity of a center of gravity of the engine.

3. The engine for a leisure vehicle according to claim 1, wherein the actuator drive oil pump is disposed in the vicinity of a rear face of a cylinder extending vertically upward from a crankcase of the engine and above the transmission.

4. The engine for a leisure vehicle according to claim 3, wherein the actuator drive oil pump is configured to be driven by a drive force transmitted from a crankshaft of the engine to the actuator drive oil pump through an output gear mounted on the crankshaft, a primary gear that is mounted on an input shaft of the transmission and is configured to mesh with the output gear of the crankshaft, a drive gear that is mounted on the input shaft of the transmission and is configured to rotate integrally with the primary gear, and a driven gear mounted on a rotational shaft of the actuator drive oil pump.

5. The engine for a leisure vehicle according to claim 4, wherein an idle gear is provided between the drive gear and the driven gear.

6. The engine for a leisure vehicle according to claim 5, wherein the actuator drive oil pump is configured to be driven by the drive force transmitted from the crankshaft in such a manner that the number of rotations of the rotational shaft of the actuator drive oil pump is less than the number of rotations of the crankshaft.

7. An engine for a leisure vehicle comprising:

a lubricating oil pump configured to feed a lubricating oil to engine components; and an actuator drive oil pump that is provided separately from the lubricating oil pump and is configured to drive an actuator operating with an oil pressure, the actuator drive oil pump being configured to feed an oil with a discharge pressure higher than a discharge pressure of the lubricating oil pump, wherein the actuator is configured to drive a variable valve system of the engine; and wherein the actuator drive oil pump is disposed in the vicinity of a rear face of a cylinder extending vertically upward from a crankcase of the engine and above and adjacent a transmission provided in a rear region of the engine.

* * * * *